United States Patent [19]

Cole et al.

[11] 4,253,289

[45] Mar. 3, 1981

[54] APPARATUS FOR COILING AND BINDING STRAND MATERIAL

[75] Inventors: Michael A. Cole, Lutherville; Walter W. Morgan, Fallston, both of Md.

[73] Assignee: Western Electric Company, Inc., New York, N.Y.

[21] Appl. No.: 92,812

[22] Filed: Nov. 9, 1979

[51] Int. Cl.[3] ..... B65B 57/10; B65B 63/06

[52] U.S. Cl. ..... 53/53; 53/73; 53/116; 53/590; 53/513; 242/48

[58] Field of Search ..... 53/53, 73, 116, 118, 53/119, 586, 590, 513; 242/48, 53

[56] References Cited

U.S. PATENT DOCUMENTS

| | | |
|---|---|---|
| 554,749 | 2/1896 | Wadsworth . |
| 708,979 | 9/1902 | Heylman . |
| 830,239 | 9/1906 | Lingenfelter . |
| 936,385 | 10/1909 | Thornburg . |
| 1,938,900 | 12/1933 | Goldsmith . |
| 2,331,004 | 10/1943 | Standish . |
| 2,377,771 | 6/1945 | Fletcher . |
| 2,386,158 | 10/1945 | Collins . |
| 2,527,502 | 10/1950 | Simison et al. . |
| 2,654,980 | 10/1953 | Dexter . |
| 2,712,836 | 7/1955 | Marzolf . |
| 2,915,580 | 12/1959 | Gill et al. . |
| 3,024,580 | 3/1962 | McIntyre . |
| 3,167,717 | 2/1965 | Fox et al. . |
| 3,416,287 | 12/1968 | Hawkins et al. . |
| 3,592,398 | 7/1971 | Mukai . |
| 3,975,883 | 8/1976 | Besnyo et al. ..... 53/118 X |

FOREIGN PATENT DOCUMENTS 855254 11/1960 United Kingdom ..... 53/116

*Primary Examiner*—Travis S. McGehee
*Attorney, Agent, or Firm*—E. W. Somers

[57] ABSTRACT

Coiling and binding of telephone cordage is accomplished by rotating a turntable of an apparatus to coil a predetermined number of convolutions of cordage thereon. The coiling occurs while a deformable tie is wrapped about a previously coiled length of cordage which has been removed from the turntable and moved to a binding position. The coiled, bound length of cordage is removed from the binding position and ejected from the apparatus. At the same time, the cordage which has just been coiled is severed from a supply, is removed from the turntable in the coiling position, and is moved to the binding position to facilitate another cycle of operation in which the coiled cordage which has been moved into the binding position is bound and ejected while the leading end of a supply of cordage is secured to the turntable. The apparatus includes intelligence for identifying a coiled length of cordage which includes a splice to prevent the binding of that length and for preventing operation of a binding device when a length of cordage has not been coiled on the turntable and moved into the binding position in a cycle of operation.

15 Claims, 19 Drawing Figures

APPARATUS FOR COILING AND BINDING STRAND MATERIAL

TECHNICAL FIELD

This invention relates to coiling and binding strand material, and, more particularly, to methods of and apparatus for providing a hank or length of coiled cordage having a plurality of convolutions that are bound together with free ends of the cordage extending in the same or opposite directions from the hank to facilitate end treatment.

BACKGROUND OF THE INVENTION

In the communications industry, telephone line cords, which connect telephone handsets to a wall outlet, are provided to an installer in the form of a length of cordage such as, for example, that described in U.S. Pat. No. 3,868,341 that is coiled in a predetermined number of convolutions which are bound with a deformable tie. Free ends of the coiled cordage are finished or terminated with modular plugs, such as, for example, those illustrated in U.S. Pat. No. 3,699,498 which issued on Oct. 17, 1972 in the names of E. C. Hardesty et al, and U.S. Pat. No. 4,148,539, which issued on Apr. 10, 1979 in the name of E. C. Hardesty. In the prior art, coil winding or hanking is shown, for example, in U.S. Pat. No. 2,654,980.

Since the cordage is coiled desirably prior to end finishing, it becomes important for the coiled configuration to be maintained intact during the finishing operation. Prior art techniques exist for the application of a tie, e.g., a thermoplastic band, about the entire coil after the convolutions thereof have been elongated so that opposite portions of the convolutions are adjacent each other. See, for example, U.S. Pat. No. 3,024,580 and U.S. Pat. No. 2,349,750, which show the bending of upper extremities of U-shaped clip to become curled over adjacent convolutions of a wire entanglement. The introduction of a tie centrally of a coil and the wrapping of the tie about one section of the coil is shown on page 19 of Western Electric Technical Digest No. 34 April, 1974 issue. Also, U.S. Pat. No. 3,975,883 shows the coiling of cordage over a linearly disposed tie after which the ends of the ties are deflected upwardly and then inwardly and each tucked under an adjacent plurality of portions of the convolutions. While some of the just-described apparatus have been used, none has been found to have the kind of reliable, high speed capability which is needed in the environment of telephone cordage production.

Another problem evolves because of the desired continuous operation of apparatus for hanking cordage. Necessarily, a trailing end of one supply of cordage is spliced to a leading end of a next successive supply, usually by a staple. It should be apparent that any length of coiled cordage which includes a splice must be identified among the hanked cords produced by the apparatus so that it can be discarded and not end finished to avoid its inadvertant shipment together with acceptable product.

Notwithstanding the abundance of apparatus in the prior art for hanking strand material, the problems of automatically coiling and tying unspliced cordage at a high rate of production with methods and apparatus which result in successive cycles of operation without malfunction are seemingly unresolved. What is needed is a simplistic apparatus which requires a relatively low investment and which provides a cycle of operation and that has sufficient intelligence to alter its cycle of operation when processing spliced cordage. The sought-after apparatus should also be capable of bypassing steps for a normal sequence of operation and of repeating steps in which a malfunction may have occured before resuming a normal cycle of operation.

SUMMARY OF THE INVENTION

The foregoing problems associated with relatively high speed hanking of strand material have been solved by the apparatus of this invention which includes means for coiling a length of cordage into a plurality of convolutions to form a coil which may have leading and trailing end portions of the wound length extending from the coil in either the same or in opposite directions for end treatment. Facilities are provided for feeding a leading and of a supply of cordage into engagement with the coiling means and for securing the leading end to same. Successive supply lengths of cordage are spliced to each other to assure continuous operation of the apparatus. However, a length of cordage which includes a staple that is generally used to splice together leading and trailing ends of successive supplies is not acceptable for final product and must be identified and discarded.

The coiling means is caused to rotate to coil a predetermined number of convolutions of cordage after which facilities are caused to be operated to sever the coiled cordage from the supply and to remove the coiled cordage with a pickup device from the coiling means and transport it into a binding position. Should a coil of cordage be present in the binding position and should that length not include a splice, the coil is bound by a deformable tie which is wrapped about the convolutions and which has its end portions twisted together. The bound coil of cordage is moved from the binding position by a pickup device which releases the cordage over a receptacle as the pickup device is returned to a position aligned with the coiling device.

The apparatus includes intelligence for identifying those coils which include a splice and for preventing the binding of those coils in the binding position so that they fall unbound into the receptacle to facilitate their identification so that they can be discarded. The apparatus also prevents the operation of a device in the binding position should a coiled cordage not be present there due, for example, to the failure of a leading end of the cordage supply being secured to the coiling means.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figures 1, 2:
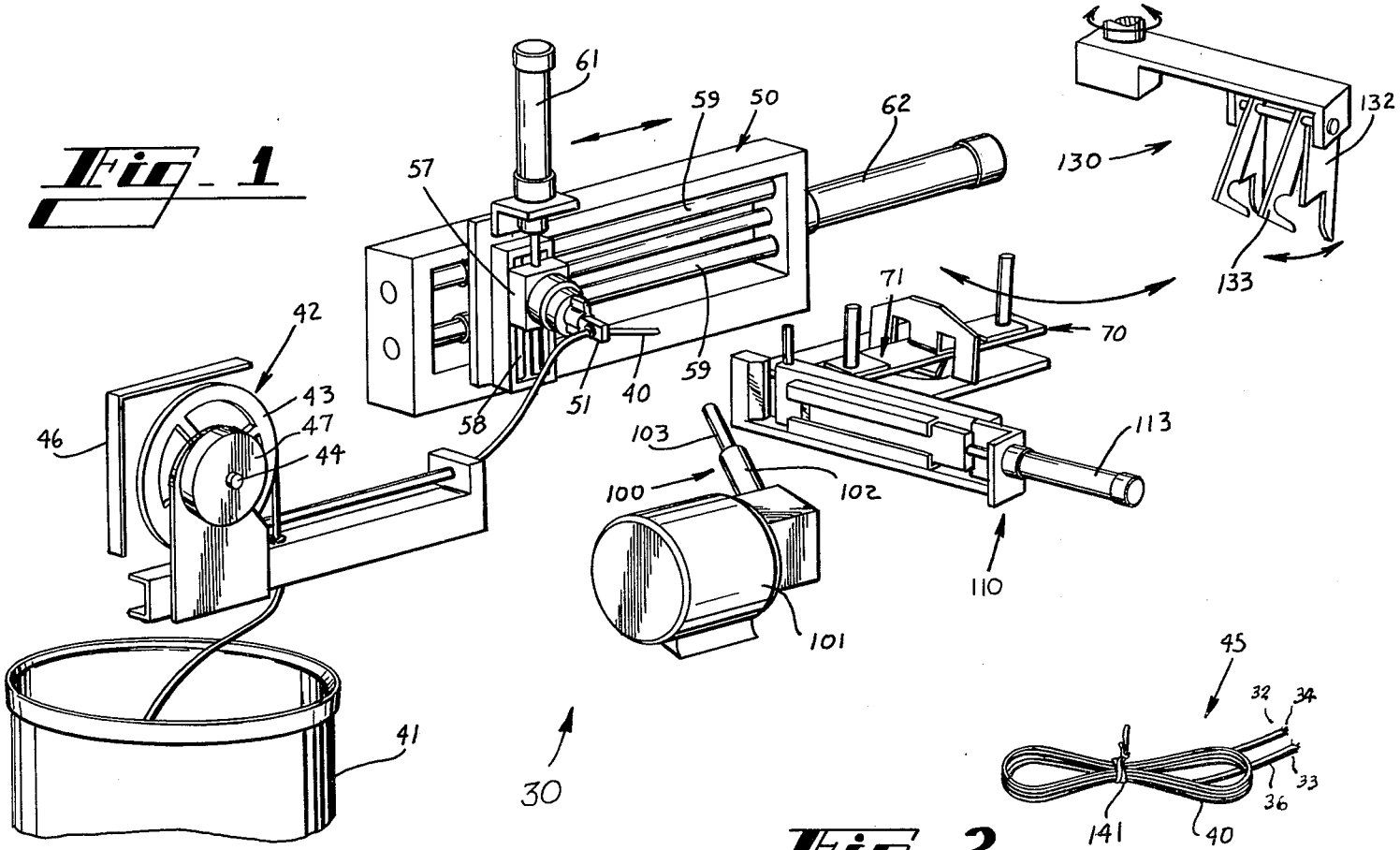
FIG. 1 is a perspective view of an apparatus of this invention for coiling and binding cordage.
FIG. 2 is a perspective view of a length of cordage that has been coiled and bound by the apparatus of this invention.

Referring now to FIG. 1, there is shown an apparatus 30 of this invention for coiling a length of telephone cordage 40 to provide a bound coiled length, designated generally by the numeral 45 (see FIG. 2) and referred to in the coil winding art as a hank, having unfinished free ends 32 and 33 to which are assembled plugs such as, for example, those disclosed and claimed n U.S. Pat. 4,148,539. The coiled cordage 40 includes a plurality of individually insulated conductors 34—34 enclosed by a plastic jacket 36.

The securing is accomplished by spanning a deformable tie, e.g., a paper or plastic-laminated wire twist-tie across the cordage 40 wound in a coil or hank such that free end portions of the tie extend beyond the coil (see FIG. 2). One such twist-tie material is available commercially from Bedford Industries of Worthington, Minn. and includes a 0.397 cm wide paper-laminated 27 gauge soft carbon steel wire. End portions of a length of the tie material are deformed to enclose the convolutions of the coiled cordage.

In the coiling of the cordage 40 into bound hanks 45—45, the cordage is advanced out of a barrel (see FIGS. 1 and 3) in which it had been deposited in a plurality of coils with a predetermined distribution, and it is advanced around a tensioning device, designated generally by the numeral 42. The tensioning device 42 includes a sheave 43 which is mounted for rotation about a horizontal axis 44 that is positioned above the barrel 41. The sheave 43 is mounted for rotation within a housing 46 through which the cordage 40 is advanced around the sheave and then in toward other portions of the coiling apparatus 30. Facilities are provided for preventing the cordage 40 from becoming displaced from a groove of the sheave as it is advanced around this sheave 43 and into the apparatus 30 which coils the cordage and binds the cordage into hanks 45—45. The tensioning device 42 also includes a hysteresis brake 47 which is used to apply tension to the cordage 40 as it is advanced in order to maintain a certain degree of tautness.

The leading end of the cordage 40 is advanced into the apparatus 30 and into a reloader, which is designated generally by the numeral 50 (see FIGS. 1, 3 and 4) and which functions to position the leading end of the cordage in engagement with coiling facilities in each cycle of operation of the apparatus. The reloader 50 includes a clamp 51 which includes a housing 52 having an opening 53 therethrough for receiving the cord. Further, the housing 52 has a slideably mounted clamping plunger therein which is moved transversely of the cordage 40 by an air cylinder 55 to clamp the cordage within the housing. The housing 52 is mounted at one end of an arm 56 that is attached to a mounting plate 57 that is moveable slideably in a vertical direction along rods 58—58 by an air cylinder 61. Further, the entire assembly of the arm 56, plate 57 and rods 58—58 are moveable in a longitudinal direction along the length of travel of cordage on a pair of horizontally disposed rods 59—59 by an air cylinder 62. At the beginning of a cycle of operation, the reloader 50 is in a down position and the leading end of the cordage 40 is threaded into the holding opening 53 of the housing 52 after which the clamp 51 is caused to be moved by the operation of the air cylinder 55 to secure the leading end of the cordage within the housing. As can best be seen in FIG. 3, this causes the leading end of the cordage 40 to be moved angularly transversely of the path of travel of the cordage as viewed in the plan view of the apparatus 30.

Figure 9:
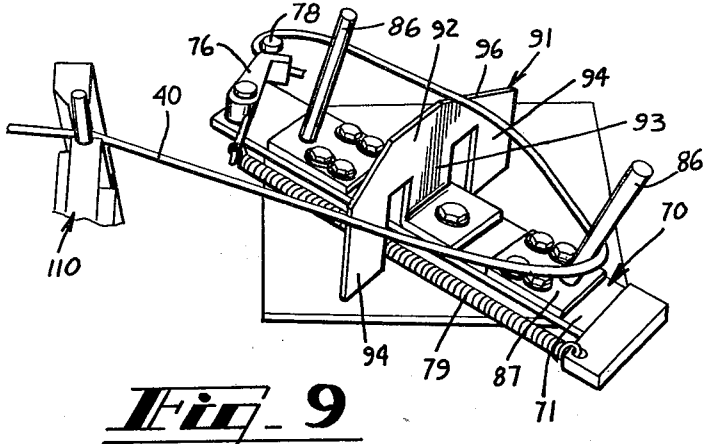
FIG. 9 is a perspective view of the coiling device of FIG. 8 with a leading end of cordage clamped thereto and one turn coiled on it.

The reloader 50 is then moved along the rods 59—59 to position the leading end of the cordage 40 in a coiling turntable, designated generally by the numeral 70 (see FIGS. 5-9). As can be seen in the drawings, the turntable 70 includes a base member 71 which is mounted horizontally and rotatably on a shaft 72. The base 71 includes two enlarged end portions 73 and 74 with one of the end portions 73 having a clamp 76 mounted pivotably on one of two shoulder bolts 77 and 78. The turntable clamp 76 is biased in a counterclockwise direction as viewed in FIG. 6 by a spring 79 which extends lengthwise along the base 71 of the turntable 70. Further, as can be seen in FIG. 9, a vertically disposed pin 81 is attached to the turntable clamp and extends through an arcuate opening 82 in the enlarged end portion 73 of the base 71 of the turntable 70 and depends for a predetermined distance therebelow. The pin 82 is designed to be engaged by a slideably moveable block 83 (see FIG. 7) which is caused to be moved by an air cylinder 84 in each cycle of operation.

Figure 3:
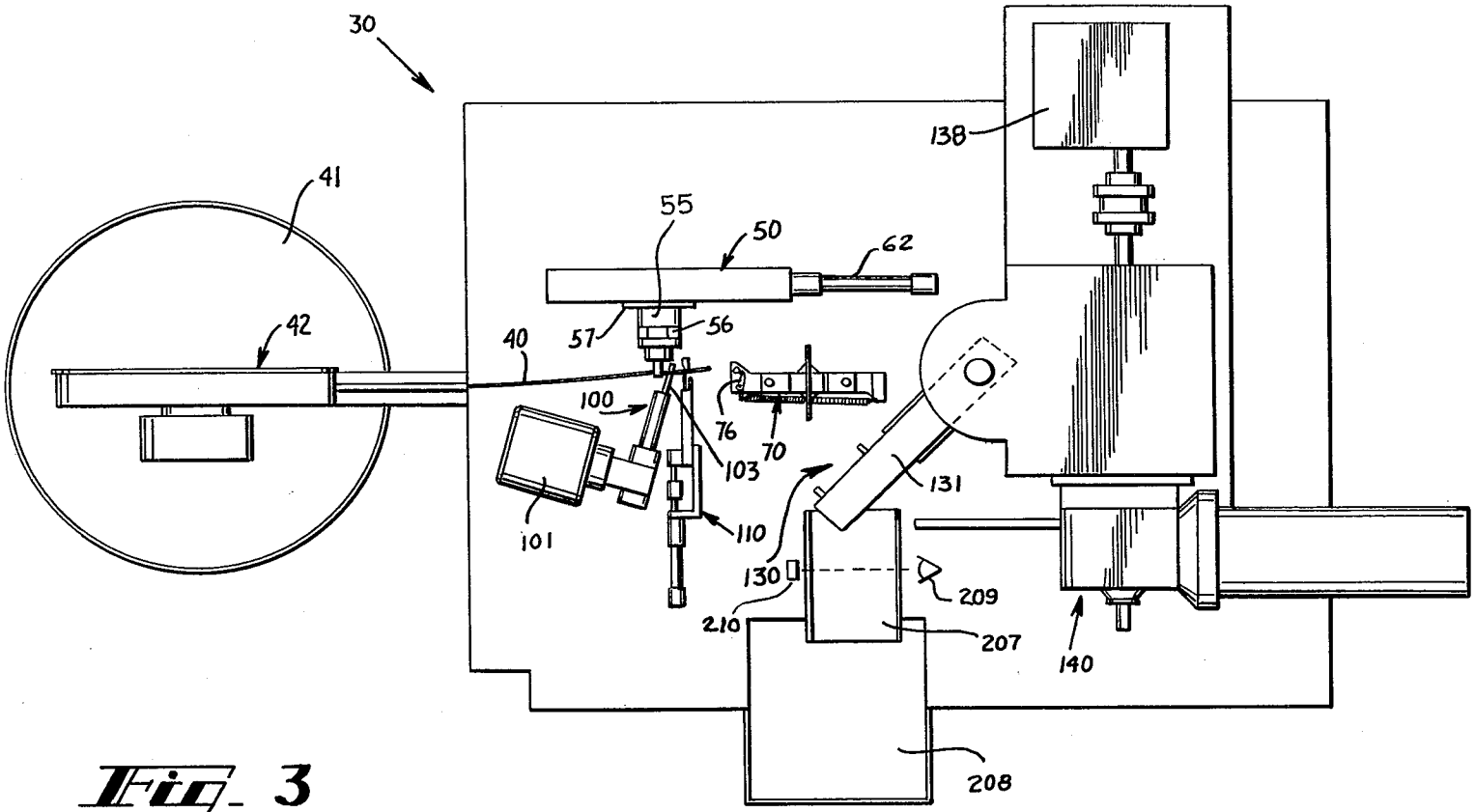
FIG. 3 is a plan view of the apparatus of FIG. 1.
Figure 4:
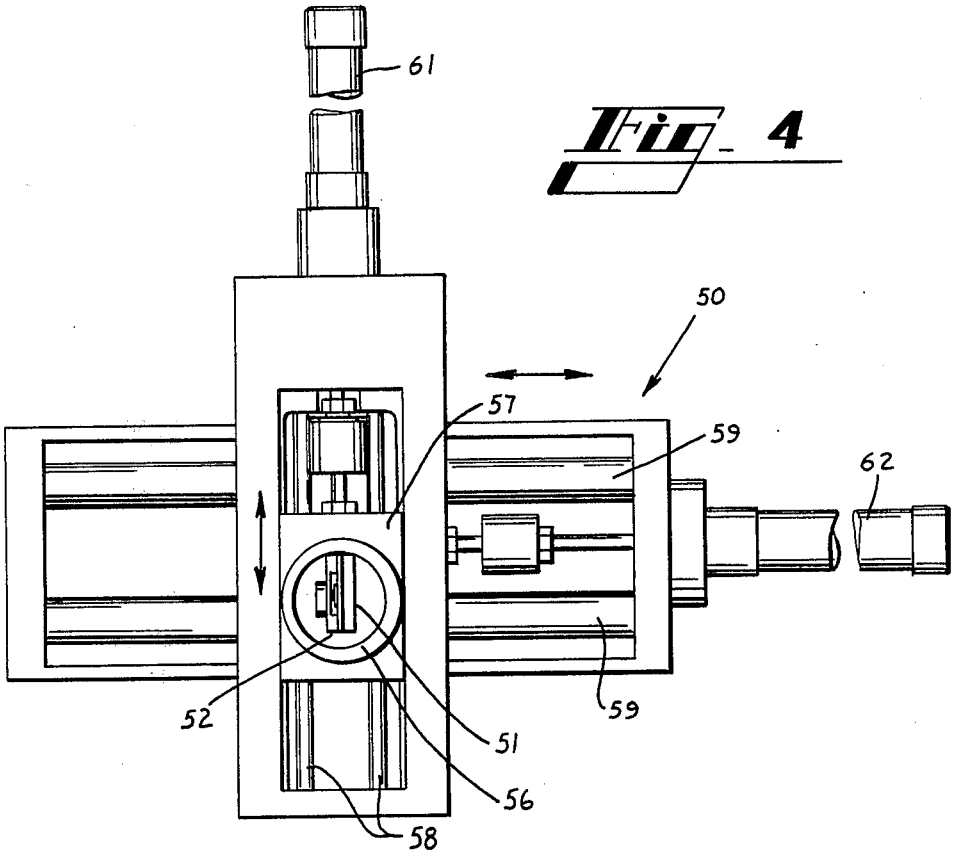
FIG. 4 is a side elevational view of a reloader which secures a leading end of a supply of cordage in engagement with coiling means in each cycle of operation.

As the reloader 50 moves to the right as viewed in FIG. 3 to deposit the leading end of the cordage 40 in engagement with the turntable 70, the air cylinder 84 is operated to move the block 83 to engage the pin 81 to cause the turntable clamp 76 to move clockwise against the urging of the spring 79 and thereby be spaced from the shoulder bolt 78. At this time, the air cylinder 61 is controlled to move the reloader 50 downwardly along rods 58—58 to position the leading end of the cordage 40 between the shoulder bolt 78 and the clamp 76. Then the air cylinder 84 is operated to withdraw its piston and to move the block 83 to the right as viewed in FIG. 7. This permits the spring 79 to cause the turntable clamp 76 to be moved counterclockwise, as viewed in FIG. 6, to clamp the leading end portion of the cordage 40 against the shoulder bolt 78.

As can be seen in FIGS. 5 through 9, the turntable 70 also includes a pair of adjustably mounted, tapered coiling posts 86—86. These posts may be moved closer toward or farther from each other since they are mounted in plates 87—87 which are attached to the base 71 through slotted openings 88—88.

Figure 8:
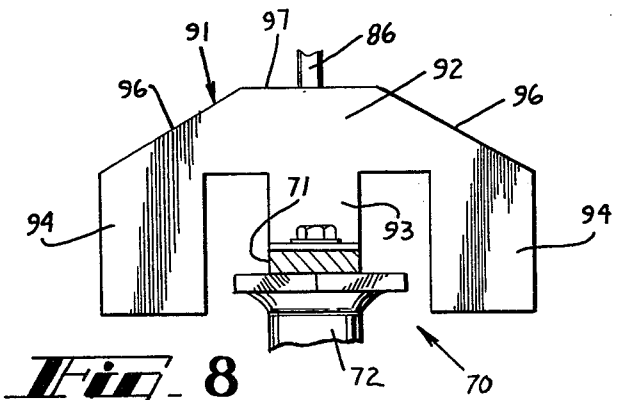
FIG. 8 is an end view of a portion of the coiling device taken along lines 8—8 in FIG. 7.
Figure 6:
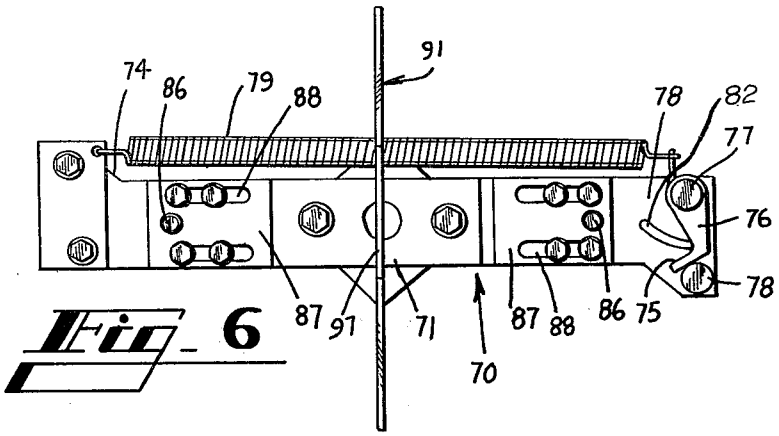
FIG. 6 is a plan view of a coiling device.

Further, as can be seen in FIG. 8, the turntable 70 includes a cross plate 91 which includes a head 92, a center stem 93 and two outboard downwardly depending legs 94—94. As can be seen from the drawings, the downwardly depending legs 94—94 extend below the level of the base 71 of the turntable 70. Further, the head 92 is formed with beveled outer portions 96—96. The cross plate 91 is attached to the turntables 70 so that it turns therewith and performs the function of maintaining the coils of the cordage 40 in a certain plane above the turntable to prevent dropping thereunder and concomitant snarling of the apparatus 30. As the turntable 70 rotates, the cordage 40 enages the beveled portions 96—96 and rides along these beveled portions until they finally come to rest on a horizontal upper portion 97 of the cross plate 91 and extend between the coiling posts 86—86. The maintenance of the coils of the cordage 40 along the plane facilitates the pickup of the coiled cordage from the turntable 70 in order to be able to move the cordage to a tying position in the apparatus 30.

In order to prepare the reloader 50 for return to an initial start position for another cycle of operation, the air cylinder 55 is controlled to release the clamp 51. Then the air cylinders 62 and 61 are controlled to move the reloader 50 to the left and down as viewed in FIG. 1 to cause the cordage 40, which extends through the unclamped reloader, to be moved into engagement with distribution facilities.

Figure 5:
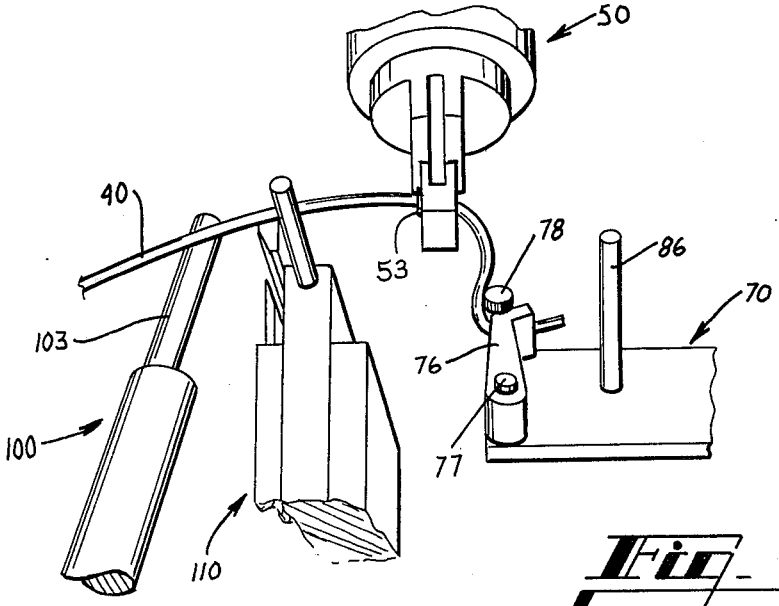
FIG. 5 is an enlarged perspective view of a portion of the apparatus which includes the reloader, a cutting device and a distributor.

As can be seen in FIGS. 1, 3 and 5, the distribution of the cordage 40 on the turntable 70 occurs along the coiling posts 86—86 with the assistance of a distributor, designated generally by the numeral 100. The distributor 100 includes a motor 101 having a mechanical connection to a continuously operated rotor 102 having an eccentrically mounted shaft 103 extending therefrom. Referring to FIG. 3, it can be seen that the rotor 102 and the shaft 103 are mounted so that they extend transversely of the path of travel of the cordage 40. As the turntable 70 is caused to rotate in a counterclockwise direction, as viewed in FIG. 3, with the leading end of the cordage 40 securing between the turntable clamp 76 and the shoulder bolt 78, the shaft 103 is caused to turn. This causes the cordage 40, which is in engagement with the shaft 103 to be moved vertically, reciprocally along the coiling posts 86—86 and to be distributed in vertically spaced convolutions.

At the conclusion of the rotation of the turntably 70, a predetermined number of convolutions of the codage 40 has been coiled between the posts 86—86. The length of cordage 40 which is coiled about the posts 86—86 may be varied by adjusting the number of turns of the turntable 70 as well as the distance between the posts. At this time, the cordage 40 extends from the coil convolutions on the turntable 70 back to the supply barrel 41 and in engagement with the shaft 103 of the distributor 100.

Figure 10:
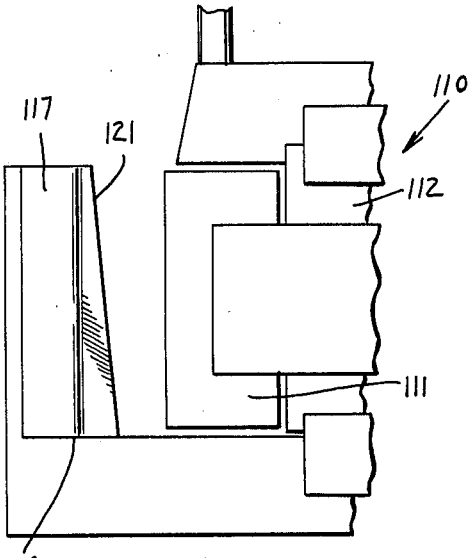
FIG. 10 is a side elevational view of a device for severing the coiled cordage from the supply.
Figure 11:
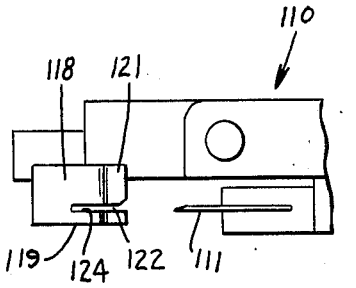
FIG. 11 is a top detailed view of a portion of the cutting device.

In a following sequence of operations, the coiled cordage 40 is prepared for transfer to a binding position in the apparatus 30 and the remainder of the apparatus is prepared for a next successive cycle of operation of coiling. In the first step of this sequence of steps, the cordage 40 extending from the turntable 70 to the supply band 41 is severed between the distributor 100 and the turntable. Prior thereto, the reloader 50 is moved vertically along the rods 58—58 by the air cylinder 61. In order to cut the cordage 40, a cutting device 110 (see FIG. 1, 3 and 10–11) is mounted for transverse movement across the path of travel of the cordage 40. The cutting device 110 includes a cutting blade 111 which is disposed in a vertical plane and attached to one end of a slideably moveable bar 112 that extends from an air cylinder 113. Upon operation of the air cylinder 113, the cutting blade 111 is moved across the path of travel of the cordage 40 to the left, as viewed in FIG. 10, to cause the cutting blade to enter a slotted opening of an anvil 116. The anvil 116 includes a backplate 117 and two sideplates 118 and 119. The sideplates 118 and 119 each have a sloping side 121 so that as the cutting blade enters the slot 122 formed between the sideplates, an increasing height of the blade is moved into engagement with an inwardly facing surface 124 of the side plate 119. Moreover, as can be seen in FIG. 11, the lower leading edge of the side plate 118 is beveled in order to facilitate the entry of the cutting blade 111 as it is moved transversely across the cordage 40. The cutting blade 111 has sufficient length so as the reloader 50 is moved to the up position, the cordage 40 is still aligned with the cutter blade to permit the severance of the coiled cordage from the supply.

Also, in this sequence of steps, the turntable clamp 76 is caused to be opened by operation of the air cylinder 84 which moves the pin 81 to the right, as viewed in FIG. 3. Further, a pickup device, designated generally by the numeral 130, (see FIGS. 1 and 3) which has been moved into alignment with and over the turntable 70 is controlled to pick up the coiled cordage 40 and transfer it to a binding position.

Figure 12:
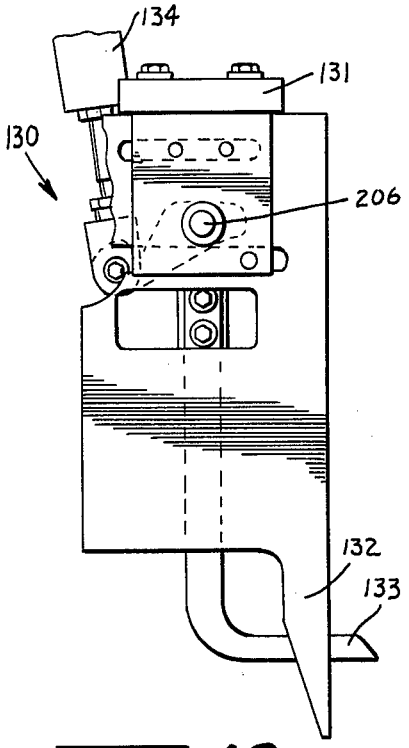
FIG. 12 is a side elevational view of a pickup device which removes the coiled cordage from the coiling means and which transfers it to a binding position and which removes the bound coiled cordage from the binding position so that it may be dropped into a collection receptacle.
Figure 13:
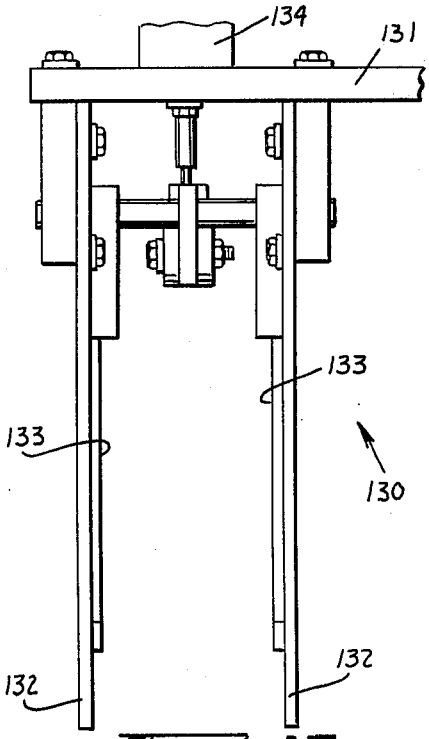
FIG. 13 is an end view of the device of FIG. 12.
Figure 14:
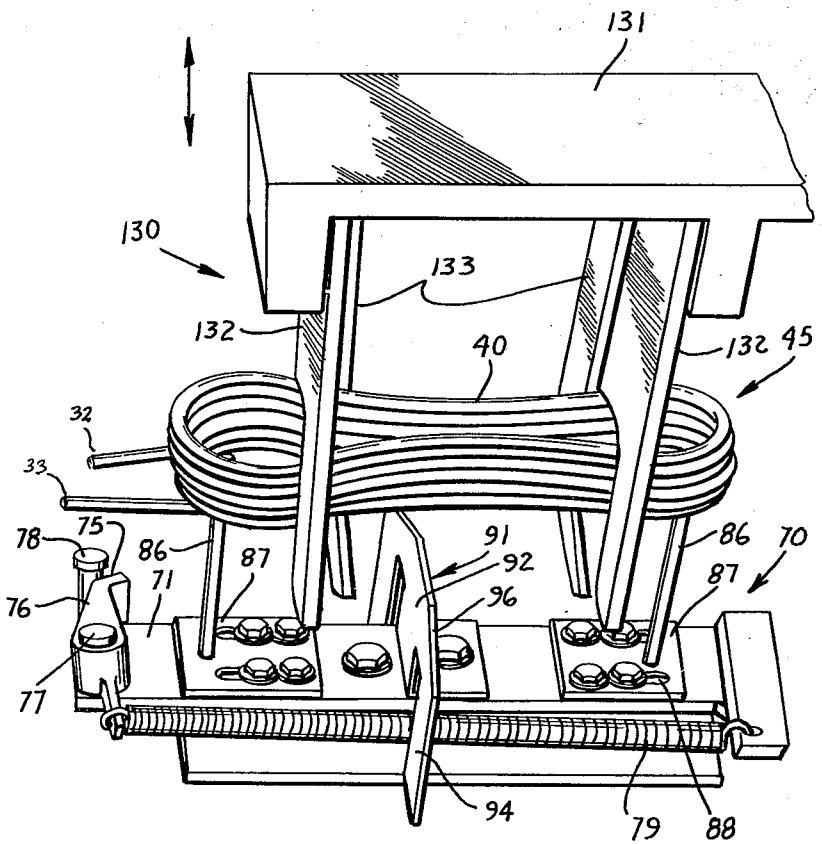
FIG. 14 is a perspective view of the pickup device of FIG. 12 removing a coiled cordage from the turntable.

The pickup device 130 (see FIGS. 12–13) includes an arm 131 from which depends two stationary fingers 132—132 and two moveable fingers 133—133. The fingers 133—133 are mounted for oscillatory movement through an arc from an open position to a closed position in which they cooperate with the stationary fingers to form an opening in which the coiled cordage is confined. When the pickup device 130 is positioned over the turntable 70, in preparation for pickup of the coiled cordage, the moveable fingers 133—133 are at an open position. After the turntable clamp 76 has been opened, the arm 131 is caused to be moved downwardly by a motor 138 which drives a cam (not shown) so that the stationary fingers 132—132 are moved past the base 71 of the turntable on one side thereof and the moveable fingers 133—133 are positioned on the other side of the base with the coiled cordage 40 on the posts 86—86 therebetween. As can be seen from FIG. 14, the stationary and moveable fingers 132 and 133 are disposed along the arm 131 so that they clear the crossplate 91 of the turntable 70 as the device is moved downwardly. Then an air cylinder 134 is controlled to move pivotally the fingers 133—133 toward the stationary fingers 132—132 to engage the coiled cordage 40 and to confine it between the stationary and the movable fingers.

The pickup device 130 is then moved upwardly from the vicinity of the turntable 70 by the motor 138 so that he coiled cordage 40 may be moved into the binding ›osition. In the binding position, the coiled cordage 40 ıeld in the pickup device 130 will have a tie secured hereabout while another length of cordage is being :oiled on the turntable 70.

At this time, the air cylinder 113 is operated to retract he cutting blade 111 from the anvil and air cylinder 62 s operated to move the reloader 50 to the right as 'iewed in FIG. 3 with the cordage extending from the upply barrel 41 being disposed above the distributor .00. Then the reloader 50 is caused to be moved downvardly along the rods 58—58 to position a new leading :nd of the cordage 40 between the clamp 76 and the houlder bolt 78. As can be seen in FIG. 3, the canting ›f the leading end of the cordage 40 from the path of .dvancement of the cordage is important to prevent the eading end from engaging one of the coiling posts ;6—86 as it is clamped into secured engagement with he turntable 70. Then the turntable clamp 76 is caused o be closed upon withdrawal of piston of the air cylinler 84 which retracts the block 83 and permits the pring 79 to move pivotally the clamp about the shouller bolt 77.

Figure 7:
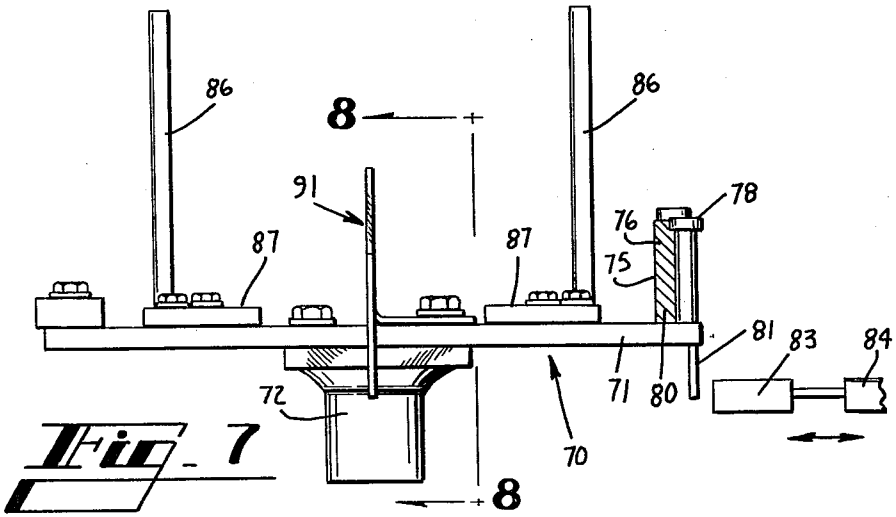
FIG. 7 is a side elevational view of the coiling device in FIG 6.

It should also be observed from FIG. 7 that an outvardly facing surface 75 of the turntable clamp 76 is ormed with serrations 80—80 at an angle to the hori:ontal. If the serrations were vertically disposed instead ›f angled, the cordage 40 could be simply slid along the ›eaks of the serrations and from between the post and he turntable clamp when the reloader is moved along he rods 58—58 to an upward position.

Then an air cylinder 55 of the reloader 50 causes the :lamping plunger 54 to withdraw thereby releasing the :ordage 40 from clamping engagement with the reoader. This is done so that as the reloader 50 is moved ıp and to the left, no undue tension is applied to the :ordage 40 which is clamped on the turntable 70. The eloader 50 is caused to be moved downwardly along he rods 58—58 to engage the cordage extending from he turntable with the distributor 100 in preparation for distribution cycle on the winding turnable 70. The oiling begins; however, it is possible that the coiling ould begin as the reloader is being moved to the left to he start position in a preferred embodiment. But here it vould begin after the reloader 50 has been moved to the .own position.

The turntable 70 is caused to rotate in a counterclockvise direction as viewed in FIG. 3 until a predeterıined number of convolutions have been coiled about he posts 86—86. It should be observed that the reloader 0 is in the down position to the left in anticipation of he cutting of the cordage in preparation for the next ycle of operation.

Meanwhile, the pickup device 130 is caused to be ırned by a motor 138 in a counterclockwise direction ɔ move the picked up, coiled cordage 40 from alignıent with the turntable 70 into binding position.

Figure 16:
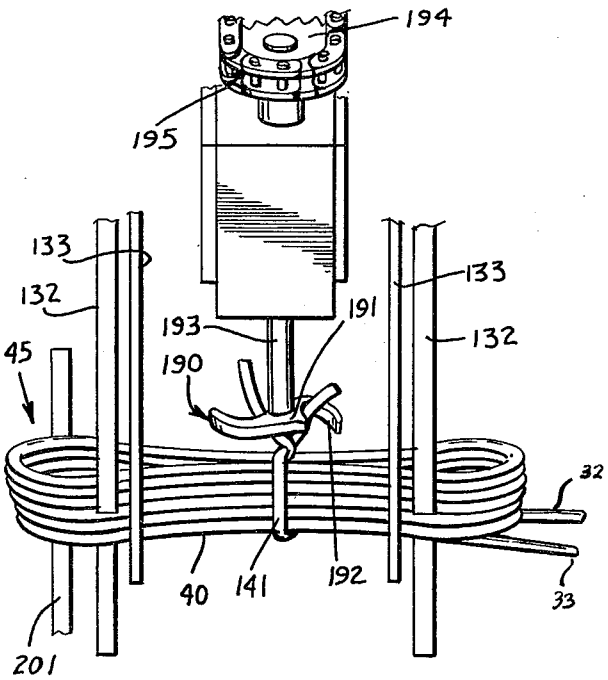
FIG. 16 is a perspective view of the device of FIG. 15 securing a tie about the coiled cordage.

It should be observed from FIG. 16 that as the pickup evice 130 is moved into the binding position, the cordge 40 which is wound and held between the stationary nd the moveable fingers 132—132 and 133—133 repectively, engages a pivotally mounted switch lever 01 which causes a control system 300 to cause the peration of a binding device, designated generally by ıe numeral 140.

Figure 15:
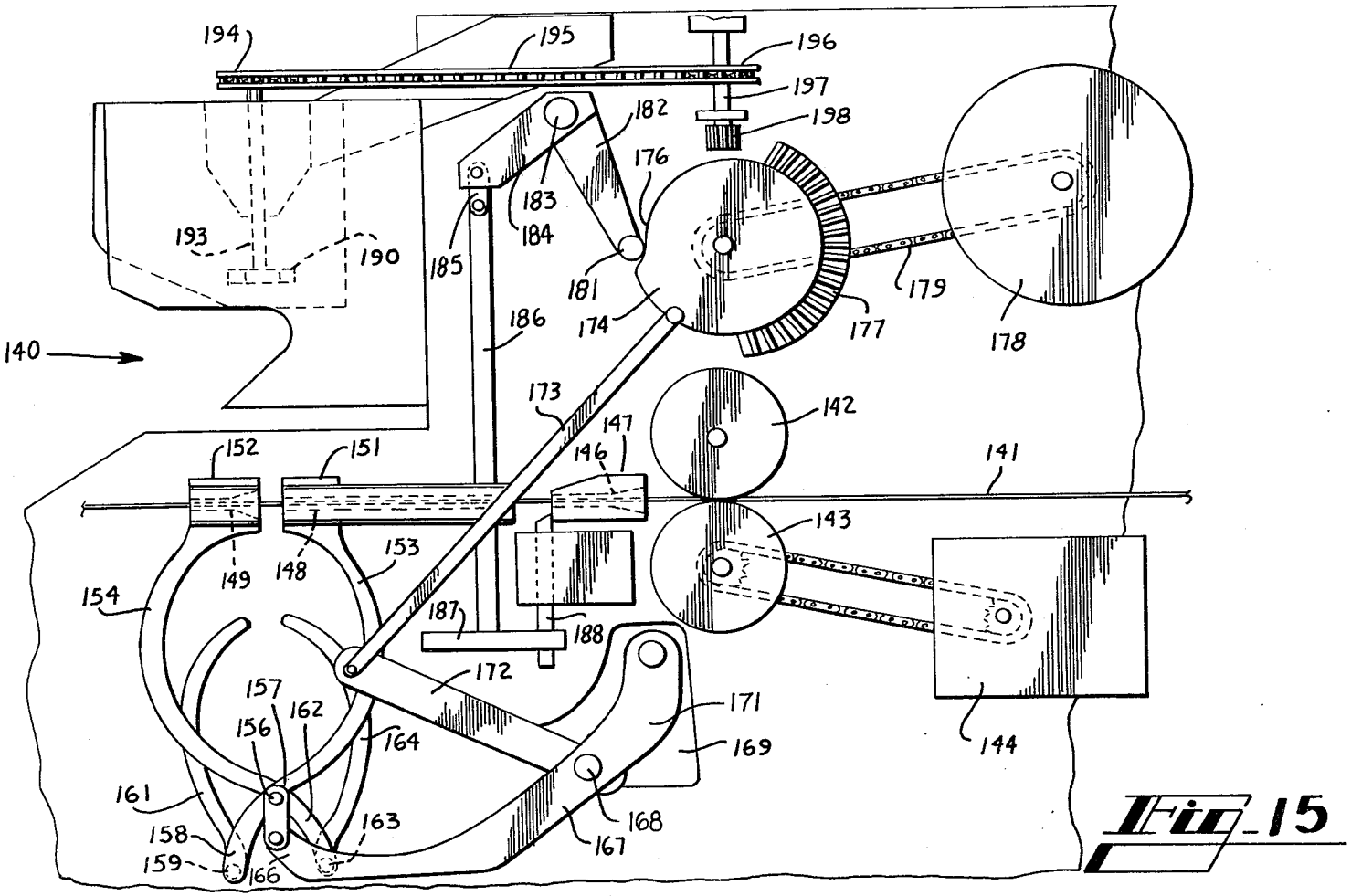
FIG. 15 is a side elevational view of a device for binding the coiled cordage with a length of deformable tie.

Referring now to FIGS. 15–16, it can be seen that the pparatus 30 includes a binding deivce 140 which comrises a supply of a well known, priorly described deformable tie called a twistem that includes a centrally disposed longitudinally extending wirelike member for causing the twistem to retain a position into which it is moved manually or by mechanical means. In the binding device 140, the deformable tie material 141 is led through a path which extends between an idler roller 142 and a drive roller 143. The twistem drive roller 143 is caused to be turned by a drive motor 144 to cause the deformable tie material to be fed from between the idler roller 142 and the drive roller 143 through an opening 146 in an anvil 147, then through openings 148 and 149 in end portions 151 and 152 of arms 153 and 154. The arms 153 and 154 have a scissors-like motion which is provided by the mounting thereof of lower portions of the arm on a pin 156 which is attached to one end of a relatively short link 157. An end 158 of the arm 153 is attached to a roller 159 which is disposed in an arcuate cam slot 161 while an end 162 of the arm 154 is attached to a roller 163 which is disposed in an arcuate cam slot 164.

The other end of the link 157 is pin-connected to an end 166 of a lever 167 which has its other end 171 pinned to plate 169. The lever 167 also has a pin 168 extending therethrough and through an end of a crank 172 and into the plate 169. Another end of the crank 172 is pin-connected to a tie rod 173 that is connected to a point adjacent the periphery of cam 174.

As can be seen in FIG. 15, the cam 174 includes a depressed portion 176 along its contour and a gear segment 177 along another portion of its contour and is mounted in the binding device for clockwise rotation of one revolution per cycle of operation of the apparatus 30 by a single revolution clutch motor 178 which is connected to the cam by a chain 179.

As the cam 174 is turned, a roller 181 is moved outwardly by the contour. The roller 181 is mounted on one end of an arm 182 of a crank that is mounted on a shaft 183 and has a second arm 184 connected thereto at the shaft. The arms of the crank rotate clockwise as a unit as viewed in FIG. 15 and cause a link 185 to move a rod 186 upwardly. A lower end of the rod 186 is fitted with a plate 187 that moves a knife blade 188 upwardly to sever the tie material 141 from the supply.

When the cam 174 turns, the tie rod 173 is caused to be moved upwardly to the right as viewed in FIG. 15 to cause the crank 172 and the plate 169 as well as the lever 167 to be turned clockwise about the pin 171. This causes the rollers 159 and 163 to be moved upwardly along the diverging, then converging slots 161 and 164. The end portions 151 and 152 are moved outwardly and then toward one another. The diverging and then converging movement of the end portions 151 and 152 permits them to draw the end portions of the length of deformable tie material about the coiled cordage 40.

The end portions 151 and 152 are moved further until the leading and newly cut trailing end portions of the length of the twistem are moved into juxtaposition with a tying head 190 having a center portion 191 and two arcuately formed tails 192—192 (see FIG. 16). When the upstanding end portions of the tie which is now in a U-shaped configuration are in juxaposition with the tying head 190, the tying head is caused to be turned by a rod 193 which has a gear 194 driven by a chain 195 that is turned by a gear 196 mounted on shaft 197. The shaft 197 has a twister gear 198 mounted on a lower end and is adapted to be moved by the gear segment 177. The turning of the head 190 causes the tails 192—192 to engage the upstanding end portions of the tie and cause them to be twisted together to secure the tie about the convolutions of the cordage 40 which extends between the arms 153 and 154.

After the tying of the free end portions of the twistem about the coiled cordage 40 to form a hank 45, the arm 131 of the pickup device is caused to be turned in a clockwise direction as viewed in FIG. 3 and at an approximately 5° to 10° angle from the binding position, the moveable fingers 133—133 are caused to be moved pivotally in a clockwise direction about an axis 206 to release the hank to permit it to descend into a chute 207 which directs it into a receptacle 208.

It should be observed that when the pickup device 130 is aligned over the turntable 70, the operation of the pickup device is caused to be delayed until the coiling of the cordage 40 is completed. Further, in a normal cycle of operation, the pickup device 130 is not caused to be moved downwardly until the coiling is complete and until a light sensor 209 which is disposed transversely across the chute 207, is broken to indicate that the coiled bound cordage 40 from the prior cycle of operation has been dropped. Dropping of the cordage is done on the fly, that is, as the arm 131 is being moved from the binding position into a position aligned with the turntable 70 for a next cycle of pickup.

The apparatus 30 of this invention is capable of adjusting to cycle of operation for processing a length of cordage 40 which includes a splice. In order to provide for continuous operation of the coiling of cordage, the trailing end of a length of cordage is spliced by conventional means to a leading end of a next supply length. The splicing of the cordage 40 is accomplished through a metal splice comprising staples which is easily detected as the cordage is advanced through the apparatus 30. Once the splice has been detected, the apparatus 30 is controlled to process that length of cordage into a coiled but untied hank so that it can be dropped in a loose configuration into the receptacle which will facilitate its identification and removal so that it is not terminated with modular plugs and sold. Once that length of cordage 40 with the splice is coiled on the turntable 70, the pickup device 130 is operated to remove the cordage from the turntable and to move it to the binding device 140. The cordage 40 engages the switch lever 201, which generates an input that is fed into the control system 300, but that electrical input is overridden by an input received from the detection of the splice. This prevents the binding device 140 from being operated and the system 300 causes the arm 131 to be swung in a reverse, clockwise direction and returned toward the turntable 70. As this occurs, the control circuit 300 causes the moveable fingers 133—133 to be moved pivotally to release the untied, coiled cordage. Moreover, in this alternate cycle of operation, the rotary movement of the pickup arm 131 is caused to be discontinued when it is aligned with the chute 207. This is done in order to assure that the released, loose cordage 40 is deposited into the receptacle. If the deposition were done on the fly, as with the normal tied cordage 40, the loose cordage containing the splice could possibly become ensnarled in other portions of the apparatus 30 and cause a malfunction. Once the movement of the arm 131 is discontinued, a timer 303 is caused to operate; after it times out, the movement of arm 131 in a rotary clockwise direction is resumed until it is aligned with the turntable 70 for a next cycle of pickup. In this first alternate cycle, because of the splice in a length of the cordage 40, the control circuit 300 is caused to operate the pickup device 130 over the turntable 70 only after the coiling of the convolutions on the next length has occured and the light beam 209 has been interrupted to indicate the deposition of the length of cordage containing the splice on the chute 207.

The apparatus 30 of this invention is also capable of adjusting its cycle of operation to prevent malfunctions caused by the absence of coiled cordage 40 on the turntable 70. In a second alternate cycle, the apparatus 30 is controlled in order to operate in the event that a leading end of a length of a cordage 40 is not secured to the turntable 70 by the clamp 76. Should the securing of the leading end not occur, cordage 40 will not be a coiled about the posts 86—86. The pick-up arm 131 which is aligned with the turntable 70 at the conclusion of its rotational movement, is caused to be moved downwardly. The moveable fingers 133—133 are caused to be oscillated to form a confining space together with the stationary fingers 132—132. Then the pickup device 130 is caused to be moved upwardly and into the tying position. Since there is no cordage 40 held between the fingers 132—132 and 133—133, the lever switch 201 is not engaged and the binding device 140 is not operated to sever and form the tie in the upstanding arms 153 and 154. Moreover, the control circuit 300 is inputted so that it does not now in this cycle of operation look for an interruption of the light beam 209 that as the pickup arm 131 is returned into alignment with the turntable 70. Hence, the arm 131 is moved downwardly in this cycle of operation only upon an indication that the correct number of turns of cordage 40 have been placed between the coiling posts 86—86. It will be recalled that in other cycles of operation, the logic calls for an "and" input which requires not only the correct number of turns to be placed on the coiling posts 86—86 but also that the light beam be interrupted to indicate that the binding device 140 is free and clear prior to pickup of the next length of coiled cordage 40.

Figure 17:
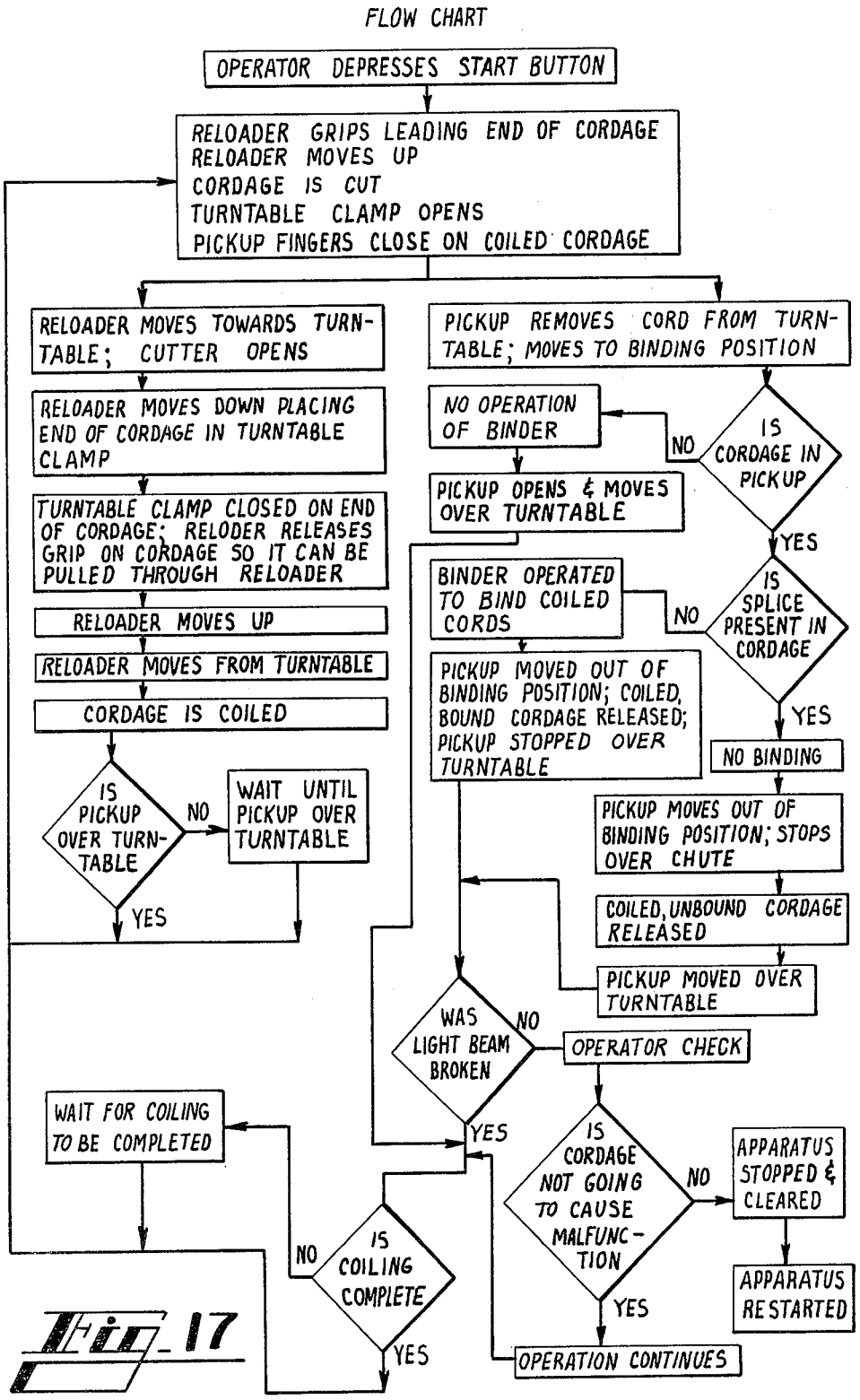
FIG. 17 is a flow chart which shows a sequence of steps of the apparatus of FIG. 1.
Figure 18:
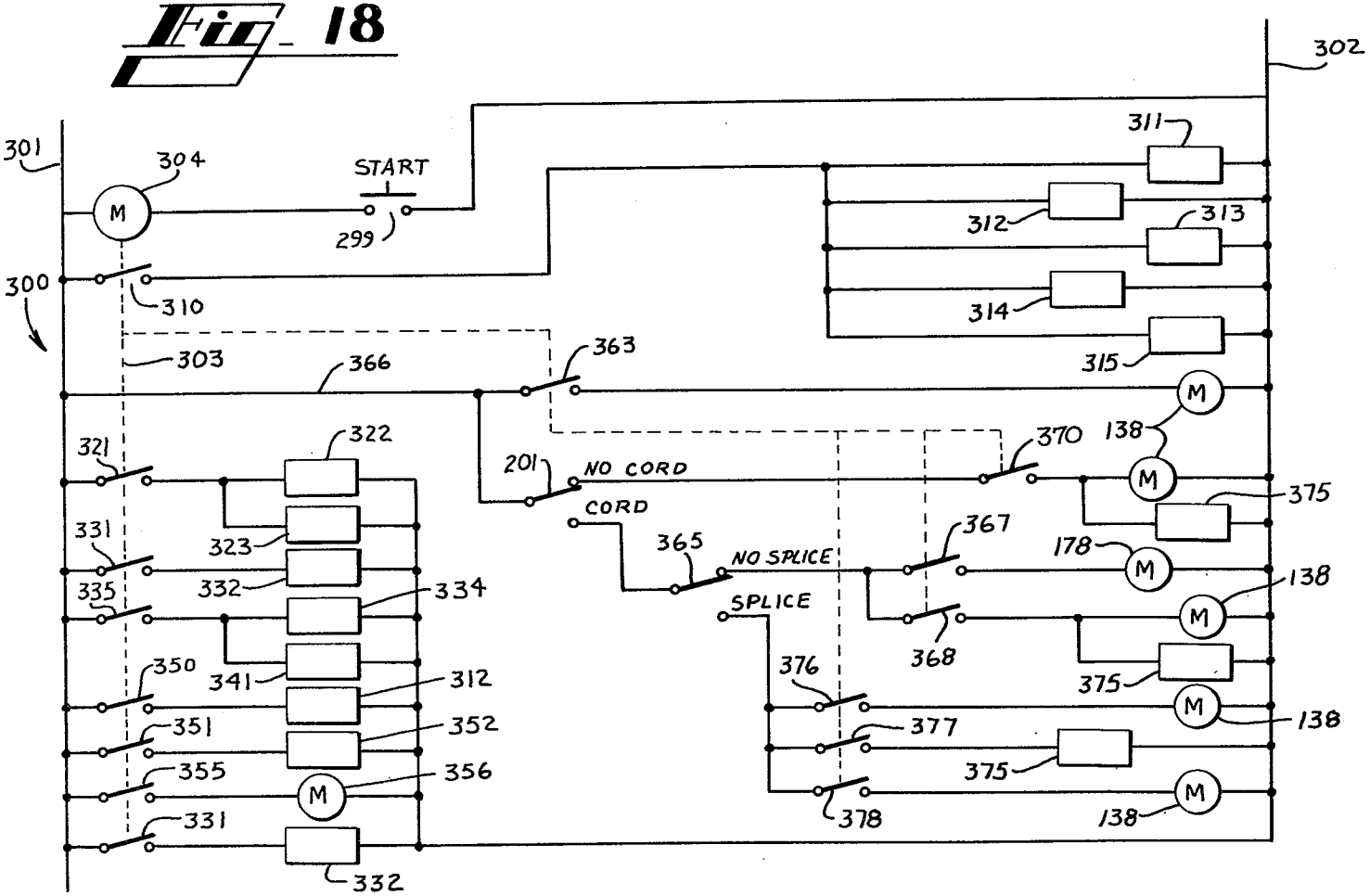
FIG. 18 is a schematic view of an electrical circuit which is used to control the operation of the apparatus of FIG. 1 in accordance with the flow chart in FIG. 17.
Figure 19:
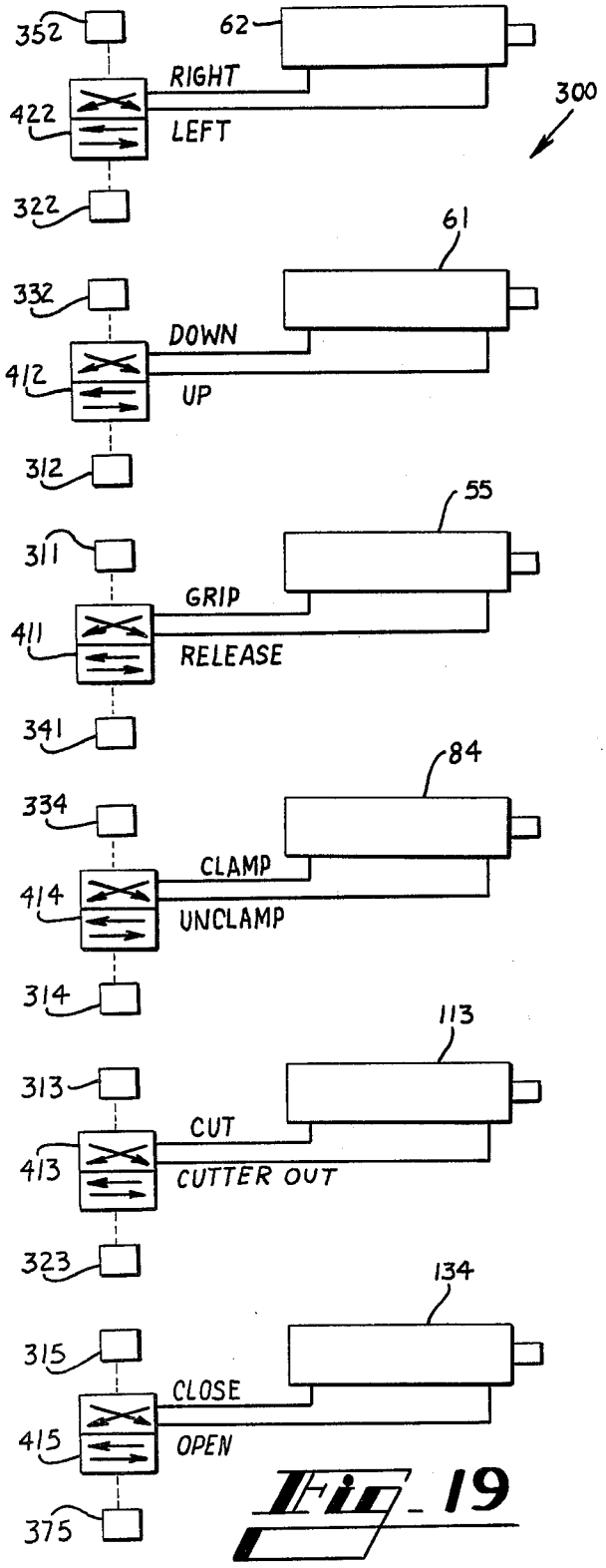
FIG. 19 is a schematic view of a pneumatic arrangement which is controlled by the electrical circuit of FIG. 18 to operate portions of the apparatus of FIG. 1.

A flow chart which shows the sequence of operations of apparatus 30 is shown in FIG. 17. In FIGS. 18 and 19, there is shown a control system 300 and associated devices which may be used to control the operation of the apparatus 30 in accordance with the flow chart of FIG. 17. After inserting a leading end of the cordage into the reloader 50, an operator depresses a pushbutton 299 (see FIG. 18) to initiate operation of the control system 300 which controls the operation of the apparatus 30 in an automatic mode. The control system 300 which is connected across electrical power lines 301 and 302 is used to operate double acting air valves to control the air cylinders which have been described hereinbefore. The control circuit 300 may include a timing mechanism, designated generally by the numeral 303, which is connected to a motor 304. The motor 304 operates a camming system whereby a plurality of contacts of the timing mechanism 303 are cam-controlled thereby energizing a plurality of solenoids to control the apparatus 30.

Referring now to the schematic flow control diagram of FIG. 17 and to the control system shown in FIGS. 18–19, in a first set of steps, the rotational movement of the motor 304 results in a cam-closing of a contract 310 which energizes simultaneously solenoids 311, 312, 313, 314 and 315. As the solenoid 311 is energized, an air valve 411 (see FIG. 19) is opened to operate the air cylinder 55 to clamp the leading end of the cordage 40. The energized solenoid 312 controls an air valve 412 to cause the air cylinder 61 to move the reloader 50 upwardly along the rods 58—58. For a cycle other than the initial cycle, the solenoid 313 causes an air valve 413 to control the air cylinder 113 to move the cutter blade 111 transverse of the cordage 40 leading from the turntable 70 to the supply barrel 41. Also, the energization of the solenoid 314 causes an air valve 414 to control the air cylinder 84 to be operated to engage the pin 81 and open the turntable clamp 76. As in the case of the cutting blade 111, this sequence of steps except for the start-up, which includes the energization of the solenoid 315 operates an air valve 415 to operate the air cylinder 134 to cause the moveable fingers 133—133 of the pickup device 130 which is aligned with the turntable 70 to be moved pivotally to confine the coiled cordage 40 in engagement with the stationary fingers 132—132.

Then the line 366 which connects across main lines 301 and 302 is completed through a switch 363 to energize the motor 138 which through a double cam arrangement (not shown) causes the arm 131 to be moved upwardly to remove the coiled cordage 40 from the turntable 70. After the arm 131 has been moved to a predetermined elevation, the motor 138 causes the arm to be turned in a counterclockwise direction as viewed in FIG. 3 to move the coiled cordage 40 into the binding position.

Going now to the left side of the circuit in FIG. 18, in one of two simultaneous sets of steps, a switch 321 is cam-closed to energize a solenoid 322 to operate an air valve 422 and cause the air cylinder 62 to move the reloader 50 toward the turntable 70. At the same time, a switch 323 is closed to operate air valve 413 to cause the air cylinder 113 to withdraw the cutter blade 111 from engagement with the anvil 116. Next, a switch 331 is closed as the motor 304 continues to turn to energize a solenoid 332 and operate the air valve 412 to cause the air cylinder 61 to move the reloader 50 downwardly along the rods 58—58 to position the new leading end of the cordage 40 between the turntable clamp 76 and the shoulder bolt 78. Continued turning of the motor 304 closes a switch 335 which in a simultaneously occuring pair of steps energizes a solenoid 334 which causes air valve 414 to cause the air cylinder 84 to be operated to retract its plunger to permit the spring 79 to return the turntable clamp 76 pivotally in a counterclockwise direction to clamp the leading end of the cordage 40. Also, a switch 340 is closed to energize a solenoid 341 and operate the air valve 411 to cause air cylinder 55 to release the cordage 40 within the reloader 50 so that the cordage may be pulled freely therethrough during coiling. Next, switch 350 is closed to energize the solenoid 312 and operate the air valve 412 to cause the air cylinder 61 to move the reloader 50 to an up position after which a switch 351 is closed to energize a solenoid 352 which operates the air valve 422 and causes the air cylinder 62 to return the reloader leftwardly as viewed in FIG. 2.

Following this, a switch 355 is closed to cause a motor 356 to rotate the turntable 70 to coil a predetermined number of turns of cordage 40 about the posts 86—86. Finally, in this sub-sequence of steps, the switch 331 is closed to energize the solenoid 332 to operate the air valve 412 and cause the cylinder 61 to move the reloader 50 downwardly so that as the coiling occurs, the cordage 40 is in engagement with the distributor 100.

As will be recalled before the description of the left side of the circuit in FIG. 18 was begun, the switch 363 had been closed to cause the motor 138 to move the coiled cordage 40 which had been removed from the turntable into the binding position. Should the switch lever (FIG. 14) not be engaged which would be indicative of the absence of a coiled cordage 40 in the pickup device 130, the motor 138 continues to operate since the binding device 140 will not be operated. The motor 138 causes the arm 131 to be moved in a clockwise direction as viewed in FIG. 3 to return the pickup device in a position aligned vertically with the turntable 70. Also, as can be seen in FIG. 18, the solenoid 375 is energized to operate the air valve 415 which controls the air cylinder 134 to swing open the moveable fingers 133—133.

Should a cord be present in the pickup device 130 from the previous cycle of operation as evidenced by an input from the switch lever 201 and should a switch 365 indicate that a splice is not present in the coiled length of cordage 40, current is supplied from the line 301 along the line 366 through the switches 201 and 365 and through now-closed contact 367 to cause the motor 178 to turn to rotate the drive roller 143 and advance a leading portion of the twistem material into engagement with the end portions of the arms 153 and 154. Also, the cam plate 174 turns to cause the arms 153 and 154 to be moved upwardly about the coiled cordage 40 and to juxtapose the ends of the twistem adjacent the tying head 190 after which the tying head is turned to secure the twistem about the coiled cord.

The position of the switches 201 and 365 also causes a contact 368 to be closed to operate the motor 138 to rotate the pickup arm 131 clockwise as viewed in FIG. 3 to move the pickup device 130 toward a position aligned with the turntable 70 where a coiling operation is occuring. About 5° to 10° from the tying position, the solenoid 375 causes the air cylinder 134 to open the moveable fingers 133—133 to release the bound coiled cordage 40 for descent along the chute 207 into the receptacle 208.

As the cordage 40 moves along the chute 207, the light beam 209 of the detector 210 is broken. A signal to the system 300 that the light beam 209 has been broken and a signal that the predetermined number of convolutions have been wound on the turntable 70 causes the motor 304 to turn and initiate another cycle of operation.

Returning now to the point in time just after the switch lever 201 has been operated to signal the presence of a cordage 40 in the pickup device 130, a signal from a detector to the switch 365 that a splice is present blocks out the twist tie step and causes the electrical circuit 300 through a closed contact 376 to jump to the movement of the pickup arm 131 toward the turntable 70. However, unlike the situation where an unspliced length of cordage 40 is present in the pickup arm 130, the presence of a splice causes the motion of the arm 131 to be discontinued over the chute 207 before a contact 377 is closed to cause the solenoid 375 to be energized to cause the air cylinder 134 to open the fingers 133—133 and release the cordage 40. Then the light beam 209 of the detector 210 is broken as before and the apparatus 30 is contitioned for another cycle of operation.

Should the reloader 50 be unsuccessful in the positioning of a leading end of the cordage 40 in the turntable 70 or should the turntable clamp 76 not engage the leading end, the switch lever 201 is not engaged i.e. in a "no cord present position" as the pickup device 130 is swung into the tie position. The binding device 140 is not operated and the pickup arm 130 is returned to a position over the turntable 70 and the fingers 133—133 opened to await a signal that coiling is complete.

It is to be understood that the above-described arrangements are simply illustrative of the invention. Other arrangements may be devised by those skilled in the art which will embody the principles of the invention and fall within the spirit and scope thereof.

What is claimed is:

1. An apparatus for coiling and binding strand material, said apparatus including:

means for coiling a length of strand material;

means moveable between a position adjacent said coiling means and a position removed therefrom for feeding a leading end of a supply of strand material into proximate engagement with said coiling means;

means for securing the leading end of the supply of strand material to said coiling means;

means for causing said feeding means to be moved to said position adjacent said coiling means and for causing said coiling means to coil a plurality of convolutions of the strand material;

means for distributing the convolutions of strand material on said coiling means;

means rendered effective by the coiling of the plurality of convolutions of strand material for severing the coiled strand material from the supply;

means for removing said coiled strand material from said coiling means, said removing means including means for holding said coiled strand material;

means responsive to the coiling and movement of a predetermined length of strand material into a binding position for binding together the convolutions of the coiled strand material to produce a bound coil of strand material;

means for moving said removing means between a position aligned with said coiling means and said binding position, said moving means in a cycle of operation of said apparatus moving said removing means for said coiling means to said binding position and, subsequent to the binding of said coiled strand material, moving said removing means through a discharge position to the position aligned with said coiling means; and means effective as the removing means is moved through the discharge position for causing said holding means to release said bound coil of strand material.

2. The apparatus of claim 1, wherein said moving means is responsive to a bound unspliced length of strand material being held in said holding means for moving said removing means through said discharge position, said apparatus including means for causing said holding means to release said bound coiled strand material as said removing means is moved through said discharge position.

3. The apparatus of claim 1, wherein said apparatus includes means for causing said holding means to release said coiled strand material, said apparatus further including means for precluding the binding of a length of strand material which includes a splice and for discontinuing movement of said removing means when it is in said discharge position so that the spliced unbound length of strand material is released while in the discharge position and for causing a resumption of movement after the strand material has been released.

4. The apparatus of claim 1, which includes means for causing said holding means to release said coiled strand material and wherein a trailing end of one supply of strand material is connected to a leading end of a following supply of strand material by a splice, said apparatus including means for detecting a splice in said length, said means for binding said coiled strand material being rendered inoperative if said coiled strand material includes a splice, said coiled strand material which includes a splice being unbound when released.

5. The apparatus of claim 1, wherein said coiling means includes a turntable, means for mounting rotatably said turntable and a pair of spaced, tapered posts upstanding from said turntable.

6. The apparatus of claim 5, wherein said coiling means includes means attached to said turntable for maintaining the coil on said coiling means at a height which facilitates pickup by said removing means.

7. The apparatus of claim 6, wherein said feeding means is moved upwardly from said coiling means prior to its movement to said position removed from said coiling means and wherein said means for securing said leading end of said strand material to said coiling means holds the leading end secured to said coiling means while said feeding means is being moved upwardly and then in a reverse direction to the position removed from said turntable preparatory to another cycle of operation.

8. The apparatus of claim 1, wherein said feeding means includes an opening through which the strand material is pulled by said coiling means and which includes means for clamping said strand material prior to its severance between it and the coiling means to facilitate positioning of a newly formed leading end into proximate engagement with said coiling means.

9. The apparatus of claim 1, which also includes photo detector means comprising a light beam spanning across a path of travel in the discharge position, the descent of bound coiled strand material along said path of travel causing said light beam to be interrupted.

10. The apparatus of claim 7, which also includes means for mounting said removing means for vertical movement in said position aligned with said coiling means and wherein said removing means is precluded from a downward movement to remove said coiled strand material until a predetermined length has been coiled and until said photo detector has been signalled by a broken light beam.

11. The apparatus of claim 1, wherein said binding means includes means for forming a tie into enclosing securing relationship with the convolutions of strand material, said apparatus including means effective in a cycle of operation for precluding the operation of said tie-forming means in the absence of a length of coiled unspliced strand material in said holding means in said binding position.

12. The apparatus of claim 10, wherein said removing means includes a pair of stationary fingers and a pair of moveable fingers, and means for moving said moveable fingers between an open and a closed position, said fingers in a closed position cooperating with said stationary fingers to confine said coiled strand material, said moveable fingers being below said maintaining means when said removing means is in a pickup position at a lower end of said vertical movement.

13. The apparatus of claim 7, wherein said securing means includes a post and a clamp mounted pivotally on said coiling means, said clamp having a plurality of serrations formed at an angle to the horizontal which is sufficient to hold the leading end of the strand material as said feeding means is moved upwardly.

14. The apparatus of claim 1, wherein subsequent to the securing of the leading end of the strand material said feeding means is moved to a position such that the cordage extending between said coiling means and the supply is in engagement with said distributing means.

15. The apparatus of claim 14, wherein said distributing means includes an eccentrically mounted roller that extends transversely of the strand material extending between said coiling means and the supply.

* * * * *